United States Patent [19]

Ybarra

[11] Patent Number: 4,934,119

[45] **Date of Patent: * Jun. 19, 1990**

[54] MOVABLE WALL ASSEMBLY

[76] Inventor: Robert Ybarra, 553 W. Comstock Ave., Glendora, Calif. 91740

[ * ] Notice: The portion of the term of this patent subsequent to Jun. 6, 2006 has been disclaimed.

[21] Appl. No.: 357,413

[22] Filed: May 26, 1989

Related U.S. Application Data

[63] Continuation of Ser. No. 71,374, Jul. 9, 1987, Pat. No. 4,835,923.

[51] Int. Cl.[5] ..... E04B 2/30

[52] U.S. Cl. ..... 52/238.1; 52/DIG. 4; 52/481; 52/483; 52/489; 52/764

[58] Field of Search ..... 52/DIG. 4, 483, 488, 52/357, 238.1, 481, 489, 764

[56] References Cited

U.S. PATENT DOCUMENTS

| | | | |
|---|---|---|---|
| 3,982,370 | 9/1976 | Buffington | 52/DIG. 4 |
| 3,292,328 | 12/1966 | Lewis et al. | 52/DIG. 4 |
| 3,852,935 | 12/1974 | Jones | 52/238.1 |
| 4,835,923 | 6/1989 | Ybarra | 52/238.1 |

*Primary Examiner*—James L. Ridgill, Jr.
*Attorney, Agent, or Firm*—Boniard I. Brown

[57] ABSTRACT

A movable wall or partition assembly having panels magnetically secured to studs by novel magnetic clips on the studs engaging magnetic means on the panels, whereby one or more panels may be quickly and easily removed and replaced without disturbing the remaining panels or the entire wall or partition assembly may be disassembled, even by office personel, for movement or storage. A novel magnetic clip for the wall or partition assembly which does not require any special stud configuration for the assembly.

12 Claims, 2 Drawing Sheets

MOVABLE WALL ASSEMBLY

This is a continuation of Ser. No. 071,374, filed 7/9/87, now U.S. Pat. No. 4,835,923, issued 6/6/89.

BACKGROUND OF THE INVENTION

1. Field of the Invention

This invention relates generally to building walls and partitions and more particularly to a novel wall or partition assembly having magnetically secured wall panels which may be easily removed and replaced, even by office personel. The invention relates also to a novel magnetic clip for the assembly.

2. Discussion of the Prior Art

One construction technique which is commonly used in constructing offices and other compartmented building structures involves the use of movable partitions or walls which may be relatively easily moved from one location to another and stored when not in use. A variety of movable wall systems of this kind have been devised.

Simply stated, a movable wall system, or wall assembly as it is referred to herein, comprises a floor runner to be secured to the floor, a header to be secured to the ceiling, in most but not all cases, studs extending between the runner and header, and wall panels extending between the runner and header and disposed edge to edge to form a wall surface. Some installations require wall panels on only one side of the wall assembly. Other installations require wall panels on both sides of the wall assembly.

One of the problems involved in designing a movable wall assembly involves releasably mounting the wall panels to the assembly in such a way that the panels may be easily removed and replaced. A variety of wall panel mounting means have been devised for this purpose. One mounting technique utilizes magnetic attraction to releasably hold the wall panels in place.

Examples of magnetic wall panel mountings are described in the following patents.

U.S. Pat. No. 3,986,312 to Calhoun, et al.:

Describes a movable wall assembly in which the wall panels mount magnetic strips which engage within longitudinal grooves in magnetic wall studs to magnetically secure the panels to the studs.

U.S. Pat. No. 3,852,935 to Jones:

Describes a movable wall assembly in which wall studs have longitudinal grooves containing magnetic strips which engage magnetic strips on the wall panels to magnetically secure the panels to the studs.

U.S. Pat. No. 3,982,370 to Buffington:

Describes a movable wall assembly in which the wall panels mount magnetic strips which engage magnetic studs to magnetically secure the panels to the studs.

U.S. Pat. No. 3,292,328 to Lewis, et al.:

Describes a movable wall assembly having a floor runner for receiving and confining the lower edges of the wall panels and magnetic means on the header and wall panels for magnetically securing the panels to the header.

SUMMARY OF THE INVENTION

This invention provides an improved movable wall assembly embodying improved magnetic wall panel mounting means. These magnetic panel mounting means are uniquely constructed and arranged to permit removal and replacement of individual wall panels by relatively unskilled persons, such as office personnel, without disturbing the adjacent panels.

A primary feature of the invention resides in magnetic clips which are attached to wall studs and contact magnetic means on the wall panels to magnetically hold the panels to the studs. Each magnetic clip includes a bracket to be secured to a wall stud and magnetic means on the bracket engaging magnetic means on a wall panel for magnetically holding the panel to the stud. In the presently preferred embodiment of the invention, the magnetic clip bracket has a mounting portion to be secured to the side of the stud which faces the wall panel and at least one end portion extending laterally beyond and toward the opposite side of the stud. This end portion of the bracket mounts the magnetic means of the clip with one side of the magnetic means substantially coplanar with the bracket mounting portion and engaging the magnetic means on the wall panel to magnetically hold the panel in place.

The particular magnetic clip disclosed is designed to magnetically secure two wall panels to a common stud with edge portions of the panels overlying the stud. The clip has two end portions extruding in opposite lateral directions beyond and toward the opposite side of the stud. Each end portion mounts magnetic means which contact magnetic means on the adjacent wall panel to magnetically secure the panel to the stud. Two specific double end bracket configurations are described.

The complete wall assembly of the invention comprises a floor runner secured to the lower ends of the wall studs and a ceiling header secured to the upper ends of the studs. The ceiling header has channels which receive the upper ends of the wall panels. The floor runner has flanges which seat the lower ends of the panels. The panels are magnetically secured to the studs in such a way that each panel may be removed and replaced without disturbing the adjacent panels.

DESCRIPTION OF PREFERRED EMBODIMENT

Figure 1:
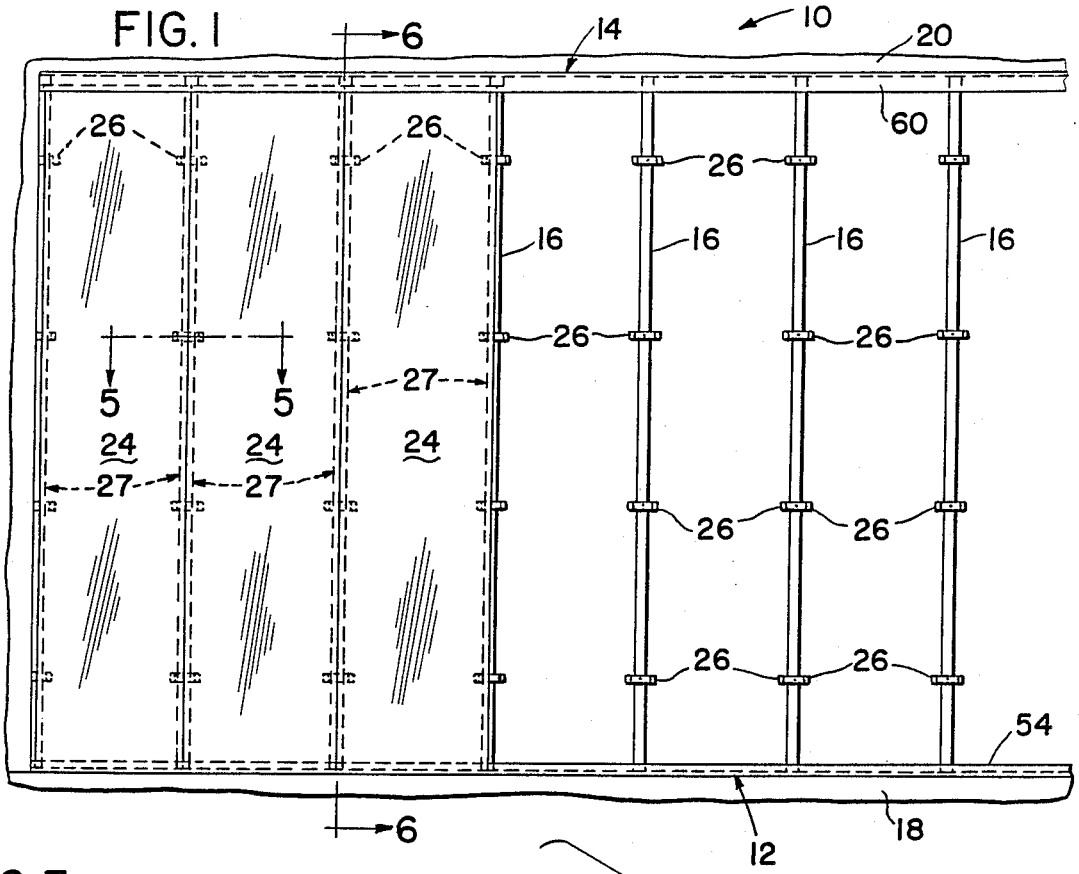
FIG. 1 is a side elevation of a movable wall assembly according to the invention with some wall panels removed to expose the wall studs and magnetic clips according to the invention.

Referring now to these drawings and first to FIGS. 1–6, there is illustrated an improved wall assembly 10 according to the invention. Wall assembly 10 includes a floor runner 12, a ceiling header 14, and studs 16 extending between the runner and header, when the wall assembly is installed, the runner is secured to the floor 18 and the header to the ceiling 20 by screws 22. One or both sides of the wall assembly is/are covered by wall panels 24. In the particular wall assembly shown, wall panels are installed on one side only of the wall assembly, although the broken lines illustrate that wall panels may be installed on both sides.

According to the present invention, the wall panels 24 are held in place in the wall assembly magnetically in such a way that the panels may be removed and replaced quickly and easily by even unskilled persons, such as office workers, to permit movement of the wall assembly from one place to another as well as storage of the wall when not in use. Moreover, any selected wall panel may be removed and replaced without disturbing the adjacent panels.

To these ends, the invention provides novel magnetic clips 26 which are mounted on the wall studs 16 and cooperate with magnetic means 27 on the wall panels 24 to secure the panels to the wall assembly. These magnetic clips constitute a primary feature of the invention.

Each magnetic clip 26 comprises a bracket 28 and magnetic means 30 on the bracket which cooperate with the wall panel magnetic means 27 to magnetically secure the adjacent wall panels to the wall assembly.

Referring now in more detail to the magnetic clips 26, each clip bracket 28 has a flat mounting portion 32 and at least one end portion 34 which is turned relative to the mounting portion so as to extend beyond one side, the normally rear or back side, of the mounting portion. The clip bracket is attached to a wall stud 16 with the bracket mounting portion 32 seating against the side of the stud facing the respective wall panels 24 and with the bracket end portion or portions extending laterally beyond and toward the opposite side of the stud.

Depending on the arrangement of a wall assembly 10, it may have one or two extreme end studs 16, such as the left-hand stud in FIG. 1. The bracket 28 of a magnetic clip 26 for installation on such an end stud may have either one or two end portions 34 depending upon the wall arrangement and the space available between the end stud and any adjacent structure. In any event, a magnetic clip 26 will be mounted on such an end stud with its single end portion 34 or one end portion extending beyond the stud toward the adjacent intermediate stud of the wall assembly, i.e., beyond the right side of the left-most stud in FIG. 1 toward the second from the left stud.

The magnetic means 30 of the magnetic clip 26 comprise a magnetic member 36 on each bracket end portion 34. The magnetic means 27 on each wall panel 24 comprise magnetic members 38, in this case magnetic strips, secured to the back side of each wall panel 24 adjacent to its vertical edges. The magnetic clips 26 and magnetic members are arranged in such a way that when a wall panel is placed in position on the wall assembly the panel is held in place by the magnetic attraction between the clip and panel members.

In the embodiment of FIGS. 1–6, the magnetic clip bracket 28 has a flat mounting portion 32. Each bracket end portion 34 includes a section 40 at right angles to and extending beyond the rear side of the mounting portion and an out-turned terminal portion 42 parallel to the mounting portion. Each magnetic member 36 of the magnetic clip 26 comprises a magnet assembly flat rectangular permanent magnet 44 between two flat rectangular, magnetically permeable pole plates 46 which project edgewise slightly beyond the edges of the magnet.

Each magnetic assembly 36, or magnet as it will be hereafter referred to, is secured, face to face, to the outer side of a right angle end section 40 of the clip bracket 28 by a fastener 48. Each magnet 36 has one edge adjacent and parallel to its bracket terminal portion 42 which keeps the magnet from turning on the fastener 48. The opposite edge off the magnet is substantially coplanar with and preferably projects just slightly beyond the bracket mounting portion 32. Each fastener 48 loosely secures its magnet 36 to the respective bracket end section 40 in such a way that the magnet has limited freedom of movement both edgewise and parallel to the fastener 48. The bracket is constructed of a non-magnetic material so as to not restrict this freedom.

Figure 3:
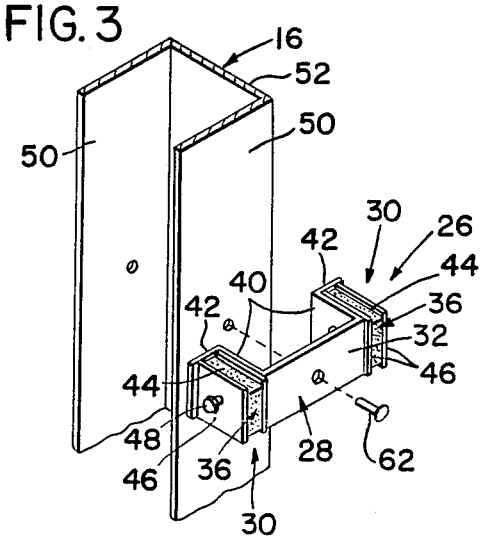
FIG. 3 is a fragmentary exploded perspective view of a wall stud and magnetic clip.
Figure 2:
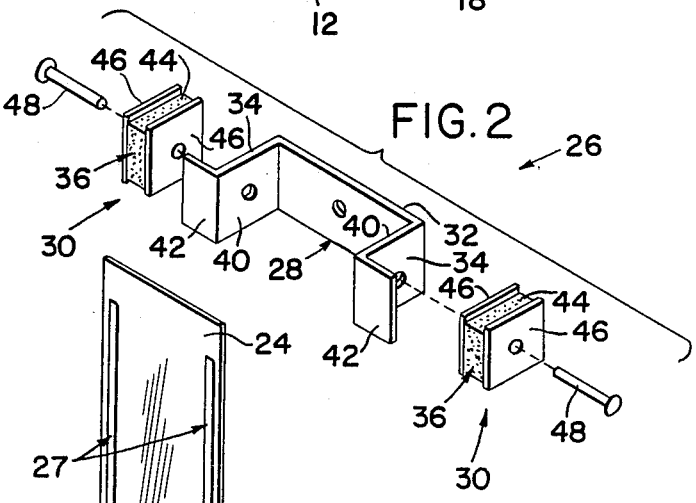
FIG. 2 is an enlarged exploded perspective view of a magnetic clip.
Figure 4:
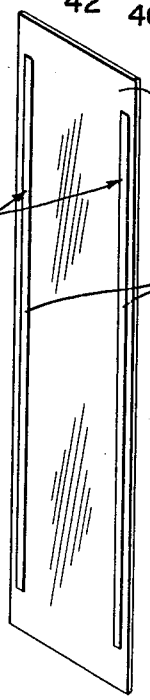
FIG. 4 is a perspective view of the inner or back side of a wall panel illustrating the magnetic means on the panel which cooperate with the magnetic clips of the invention to magnetically secure the panel to the wall studs.

As shown best in FIG. 3, each wall stud 16 is a channel having parallel flanges 50 joined by a web 52. The floor runner 12 is an upwardly opening channel having upstanding flanges 54 joined by a web 56 which seats on and is secured to the floor 18. The ceiling header 14 is an extrusion having inner depending flanges which are slotted at intervals to form pairs of laterally aligned depending fingers 58, and outer depending flanges 60.

The studs are vertically positioned, usually at uniform intervals, along the floor runner 12 and ceiling header 14 with the stud flanges 50 parallel to the sides of the wall assembly. The lower ends of the studs are positioned within and secured to the floor runner channel, as shown best in FIG. 6. The upper stud ends are positioned within the ceiling header channel with the header fingers 58 positioned between and secured to the stud flanges 50.

Figure 5:
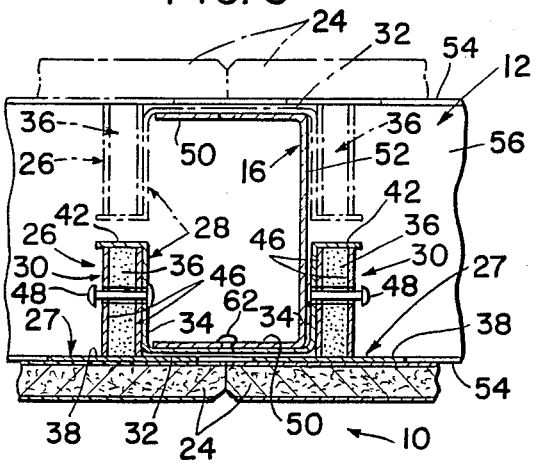
FIG. 5 is an enlarged section taken on line 5—5 in FIG. 1.
Figure 6:
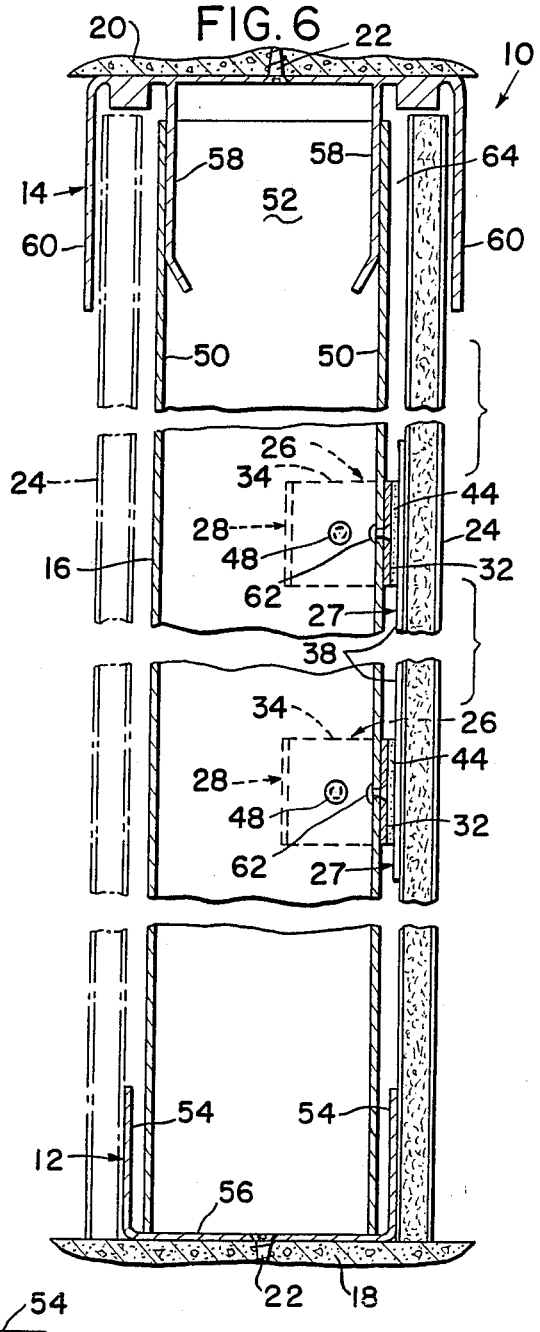
FIG. 6 is an enlarged section taken on line 6—6 in FIG. 1.

Each magnetic clip 26 is mounted on its stud at the side of the stud, i.e., the stud flange 50, to which wall panels 24 are to be installed. In the drawings, this is the front side in FIG. 1, bottom side in FIG. 5 and right side in FIG. 6. As mentioned earlier and shown in broken lines in FIGS. 5 and 6, however, wall panels may be installed on both sides of the wall assembly. Referring particularly to FIGS. 3 and 5, each magnetic clip is placed on its stud with the mounting portion 32 of the clip bracket 28 seating against the adjacent stud side or flange and with its end portions 34 extending laterally beyond and toward the opposite side of the stud in straddling relation to the stud. As mentioned earlier, the magnetic clips mounted on the end studs, such as the left-hand stud in FIG. 1, may have only one bracket end portion and magnet. Each clip is secured to its stud by a fastener 62 extending through the clip bracket mounting portion 32 and adjacent stud flange 50. Several magnetic clips 26 are mounted along each stud.

The width of the wall panels 24 substantially equals the center-to-center spacing between the studs 16. The wall panels are installed on the wall assembly with their upper ends engaging within the space 64 between the ceiling header fingers 58 and outer flanges 60 and their lower ends close to or seating against the floor runner flanges 54. The several wall panels are disposed edge to edge with the adjacent vertical edges of each pair of adjacent panels overlying a common intervening stud 16 and with the adjacent magnetic members or strips 38 on the panel in contact with the adjacent magnetic clip magnets 36.

The wall panels 24 are thus magnetically held in place in the wall assembly by the magnetic attraction between the magnetic clips 26 and wall panel magnetic members 38. The panels may be quickly and easily removed by pulling outwardly on the lower ends of the panels sufficiently to enable the upper panel ends to be withdrawn from the ceiling header space 64. In this regard, it will be observed in FIG. 6, that the width of the space 64 is greater than the thickness of the panels so as to enable the lower ends of the panels to be pulled outwardly. Installation of the panels is accomplished by reversing this procedure. Since adjacent panels do not interfit in any way, any one or more panels may be removed and replaced without disturbing the adjacent panels.

Figure 7:
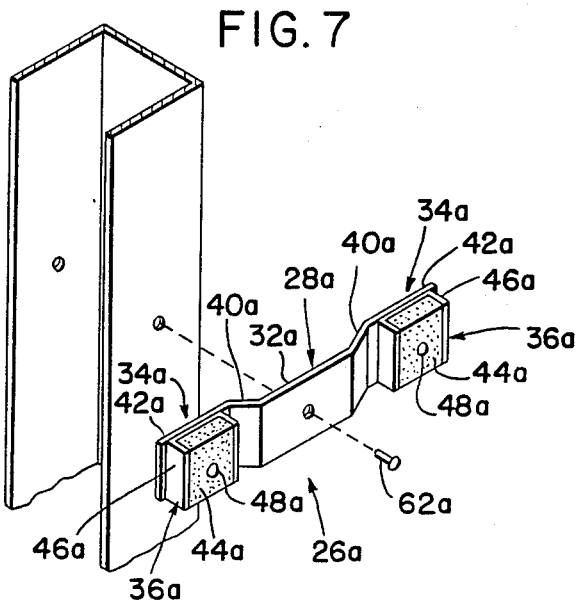
FIG. 7 is an exploded perspective view of a wall stud and a modified magnetic clip according to the invention.
Figure 8:
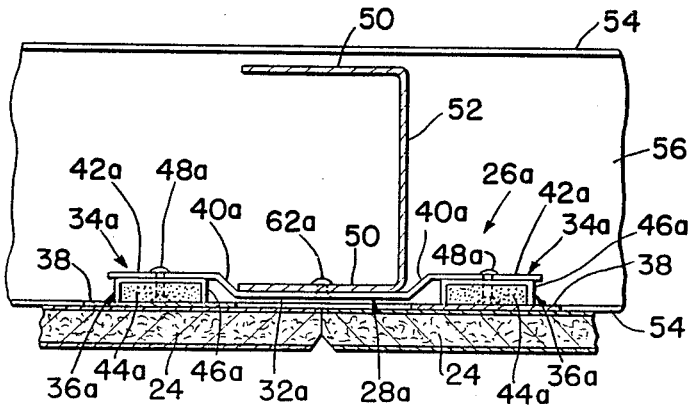
FIG. 8 is a section similar to FIG. 5 through a wall assembly embodying the modified magnetic clip of FIG. 7.

The modified magnetic clip 26a of FIGS. 7 and 8 is similar to the magnetic clip 26 and like the latter clip includes a non-magnetic bracket 28a having a mounting portion 32a and end portions 34a offset to the same side of the mounting portion. Each clip end portion 34a has an end section 40a and a terminal section 42a. Unlike clip 26, the terminal sections 42a of clip 26a are disposed in a common plane parallel to and offset to one side (the rear side) of the clip mounting portion 32a. Each clip magnet 36a is generally flat and rectangular and includes a magnetic channel 46a containing a permanent magnet 44a and is loosely secured to a clip bracket end section 42a by a fastener 48a. The magnets 36a are disposed substantially in a common plane parallel to the clip bracket mounting portion 32a with their front faces substantially flush with or, preferably, projecting slightly forwardly of the mounting portion.

The modified magnetic clip 26a is installed on a stud 16 in the same way as the magnetic clip 26 with the clip mounting portion 32a secured to the stud by a fastener 62a and with the clip bracket end portions 42 extending laterally beyond and toward the opposite side of the stud. The clip magnets 36a engage the magnetic members or strips 38 on the adjacent wall panels to magnetically hold the panels in position.

The inventor claims:

1. A magnetic wall panel mounting clip comprising:
a bracket having a relatively flat elongated mounting portion and an end portion at one end of said mounting portion including a section substantially at right angles to and extending beyond one side of said bracket mounting portion,
a magnetic member on said one bracket end portion having a surface exposed at the other side of said mounting portion and disposed substantially in a plane substantially parallel to and lying close to said other side of said mounting portion, and
means loosely securing said magnetic member to said right angle bracket section for limited floating movement of said magnetic member relative to and endwise of said bracket.

2. The subject matter of claim 1, wherein:
said securing means comprises a fastener extending through said magnetic member endwise of said bracket mounting portion for limited floating movement of said magnetic member along said fastener.

3. A magnetic wall panel mounting clip comprising:
a bracket having a relatively flat elongated mounting portion and an end portion at one end of said mounting portion including a terminal section substantially parallel to and offset to said one side of said mounting portion,
a magnetic member on said end portion having a surface exposed at the other side of said mounting portion and disposed substantially in a plane substantially parallel to and lying close to said other side of said mounting portion, and
means loosely securing said magnetic member to said bracket terminal section for limited floating movement of said magnetic member relative to and endwise of said bracket mounting portion.

4. A magnetic wall panel mounting clip comprising:
a bracket having a relatively flat elongate mounting portion and end portions at opposite ends of said mounting portion including sections substantially at right angles to and extending beyond one side of said bracket mounting portion,
magnetic members on said right angle bracket sections, respectively, having surfaces exposed at the other side of said mounting portion and disposed substantially in a common plane substantially parallel to and lying close to said other side of said mounting portion, and
means loosely securing said magnetic members to said right angle bracket sections, respectively, for limited floating movement of said magnetic members relative to and endwise of said bracket mounting portion.

5. A magnetic wall panel mounting clip comprising:
a bracket having a relatively flat elongate mounting portion and end portions at opposite ends of said mounting portion having terminal sections, respectively, substantially parallel to and offset to one side of said bracket mounting portion,
magnetic members on said terminal sections of said bracket end portions, respectively, having surfaces exposed at the other side of said mounting portion and disposed substantially in a common plane substantially parallel to and lying close to said other side of said mounting portion, and
means loosely securing said magnetic members to said bracket terminal sections, respectively, for limited floating movement of said magnetic members relative to and endwise of said bracket mounting portion.

6. A magnetic wall panel mounting clip comprising:
a bracket having a relatively flat elongate mounting portion and an end portion at one end of said mounting portion,
a magnetic member on said bracket end portion, and
means loosely securing said magnetic member to said bracket end portion for limited floating movement of said magnetic member relative to and endwise of said bracket mounting portion.

7. A magnetic wall panel mounting clip comprising:
a bracket having a relatively flat elongate mounting portion and end portions at opposite ends of said mounting portion,
magnetic members on said bracket end portions, respectively, and
means loosely securing said magnetic members to said bracket end portions, respectively, for limited floating movement of said magnetic members relative to and endwise of said bracket mounting portion.

8. A magnetic wall panel mounting clip comprising:
a bracket having a relatively flat, elongate mounting portion, and
a magnetic member secured to one side of said bracket for floating movement relative to and endwise of said mounting portion.

9. A magnetic wall panel mounting clip comprising:

a bracket having a relatively flat, elongate mounting portion, and an end portion at one end of and disposed beyond one side of said mounting portion, and a magnetic member secured to said bracket end portion and having a surface exposed at the other side of said mounting portion.

10. A magnetic wall panel mounting clip according to claim 4 wherein:

said magnetic member surface is disposed in a plane substantially parallel to and lying close to the other side of said bracket mounting portion.

11. A magnetic wall panel mounting clip comprising:

a bracket having a relatively flat, elongate mounting portion and end portions at opposite ends of and disposed beyond one side of said mounting portion, a magnetic member secured to each of said bracket end portions, respectively, and said magnetic members having surfaces exposed at the other side of said bracket mounting portion.

12. A magnetic wall panel mounting clip according to claim 11 wherein:

said magnetic member surfaces are disposed substantially in a common plane parallel to and lying close to the other side of said bracket mounting portion.

* * * * *